US005286166A

United States Patent [19]

Steward

[11] Patent Number: 5,286,166

[45] Date of Patent: Feb. 15, 1994

[54] AUTOMATIC CENTRIFUGAL FORCE VARIABLE PITCH PROPELLER

[76] Inventor: Richard B. Steward, P.O. Box 15608, Rio Rancho, N. Mex. 87174-0608

[21] Appl. No.: 20,042

[22] Filed: Feb. 19, 1993

Related U.S. Application Data

[63] Continuation-in-part of Ser. No. 885,378, May 19, 1992, abandoned.

[51] Int. Cl.[5] ..... B63H 1/06

[52] U.S. Cl. ..... 416/89; 416/87; 416/136

[58] Field of Search ..... 416/87, 88, 89, 101, 416/136, 137, 140

[56] References Cited

U.S. PATENT DOCUMENTS

| | | | |
|---|---|---|---|
| 1,482,690 | 2/1924 | Lanzius . | |
| 1,879,935 | 9/1932 | Hill | 416/140 R |
| 1,953,682 | 4/1934 | Kelm | 416/89 |
| 2,005,343 | 6/1935 | Kent | 416/137 |
| 2,080,955 | 5/1937 | Watkins | 416/140 R |
| 2,108,245 | 2/1938 | Ash | 416/88 |
| 2,120,168 | 6/1938 | Ash | 416/88 |
| 2,126,202 | 8/1938 | McColly | 170/66 |
| 2,134,157 | 10/1938 | Thompson | 416/140 R |
| 2,264,568 | 12/1941 | Hamilton | 416/89 |
| 2,282,077 | 5/1942 | Moore | 416/89 |
| 2,415,421 | 2/1947 | DeFilippis | 416/89 |
| 2,457,576 | 12/1948 | Littrell | 416/89 |
| 2,510,216 | 5/1950 | Figley | 170/160.11 |
| 2,693,242 | 11/1954 | Elmer | 416/140 R |
| 3,567,336 | 3/1972 | Bartha | 416/140 R |
| 4,365,937 | 12/1982 | Hiebert et al. | 416/157 R |
| 4,374,631 | 2/1983 | Barnes | 416/23 |
| 4,439,108 | 3/1984 | Will | 416/131 |

FOREIGN PATENT DOCUMENTS 2346912 3/1975 Fed. Rep. of Germany ..... 416/89

*Primary Examiner*—Edward K. Look
*Assistant Examiner*—Mark Sgantzos
*Attorney, Agent, or Firm*—William E. Hein

[57] ABSTRACT

An automatic centrifugal force variable pitch propeller assembly includes a plurality of propeller blades mounted within a housing, each of the propeller blades being mounted to permit limited radial travel in its entirety and simultaneous incremental rotation about its longitudinal axis, the limited radial travel of each of the propeller blades in its entirety being caused by a centrifugal force developed by rotation of the propeller assembly and extending between an inward position corresponding to rotation of the propeller assembly at an idle speed and outward position corresponding to rotation at a maximum speed. The propeller assembly includes a pitch change mechanism that is coupled to the shaft end of each of the propeller blades and is solely responsive to radial travel of each of the propeller blades, caused by the centrifugal forces developed by rotation of the propeller assembly, for causing an identical predetermined incremental rotation of each of the propeller blades about its longitudinal axis that is a nonlinear function of the radial travel of each of the propeller blades. The propeller assembly also includes a rigid mechanical interconnection between the shaft ends of each of the propeller blades to insure that the propeller blades travel radially in their entirety in concert with each other to provide fail safe operation of the propeller assembly.

3 Claims, 2 Drawing Sheets

AUTOMATIC CENTRIFUGAL FORCE VARIABLE PITCH PROPELLER

REFERENCE TO RELATED APPLICATION

This is a continuation-in-part application of application Ser. No. 07/885,378 filed May 19, 1992, now abandoned.

BACKGROUND AND SUMMARY OF THE INVENTION

This invention relates generally to propellers, vanes, impellers, and paddles of the type typically employed on aircraft, ships, wind-powered electric generators, windmills, turbine engines, etc. More particularly, the present invention is directed to a mechanism for automatically changing the pitch of blades utilized in such propellers and similar types of devices.

It is generally advantageous to provide the capability of varying the pitch or angle of attack of aircraft propeller blades, for example, in order to accommodate different flight conditions. Propellers whose pitch angle may be varied in flight are known as constant speed propellers. Various mechanisms are known for varying the pitch angles of propellers and other types of blades while they are rotating about a central shaft. Most of these mechanisms are a maze of gears and governors electrically or hydraulically actuated and represent effective, but expensive, ways in which pilots may regulate the pitch of propellers during flight.

U.S. Pat. No. 1,482,690 to Lanzius is directed to a propeller in which an axially movable collar causes each blade shank to rotate as it engages a slot in the shank. Centrifugal weights are located at 90 degrees to the propeller blades. The propeller blades do not extend or retract due to centrifugal force, and their rotation is fixed by a helical groove in the propeller shaft.

U.S. Pat. No. 4,374,631 to Barnes is directed to a windmill speed limiting system in which only the blade tips, rather than the entire blade, are adapted to extend during operation. As the blade tips extend, their pitch angle changes in accordance with a slotted cam in a bushing.

U.S. Pat. No. 2,126,202 to McColly is directed to a governor for windmills that utilizes a helix in a slide guide to allow the windmill blade to change pitch to limit the windmill RPM.

U.S. Pat. No. 2,510,216 to Figley is directed to an apparatus for controlling the pitch angle of aircraft propellers manually from the cockpit by means of a cable and pulley arrangement. The cable and pulley regulate radial movement of an extendable shaft within a hollow propeller. A pin following a helical groove in the extendable shaft varies the pitch of the propeller as the pilot operates the cable and pulley derangement.

U.S. Pat. No. 4,439,108 to Will is directed to a windmill in which centrifugal force is used to feather the rotors to control rotor speed. The windmill rotors do no extend or retract, but are mounted at a predetermined compound angle to the hub and are not in direct alignment with the center of the hub. As wind speed increase, the offset arrangement of the rotors and centrifugal force causes a reduction in the pitch angle of the rotors to thereby produce a braking effect.

U.S. Pat. No. 4,365,937 to Hiebert, deceased et al. is directed to an adjustable pitch propeller drive in which pitch changes are effected by a rack and pinion arrangement controlled by a hydraulic cylinder.

U.S. Pat. No. 2,415,421 to De Filippis is directed to an adjustable propeller that employs a helical cut-out or slot in a hollow stem of each blade and a camming pin in engagement with the helical slot to impart radial motion to the blades, as well as corresponding pitch angle changes.

U.S. Pat. No. 1,953,682 to Kelm is directed to an automatic variable pitch propeller in which a shifting pin follows a helical or cam slot in a guide tube to effect pitch changes corresponding to radial motion of the propeller blades caused by centrifugal force developed by the rotating propeller.

U.S. Pat. No. 2,282,077 to Moore is directed to variable pitch propeller in which blade turning pins or studs seated in the propeller shanks follow arcuate cam slots in hub sleeves to effect pitch changes corresponding to radial motion of the propeller blades caused by centrifugal force developed by the rotating propeller.

U.S. Pat. No. 2,264,568 to Hamilton is directed to mechanism for automatically feathering the blades of a model airplane propeller when the engine stops. A cross pin follows spiral slots in a bushing to effect pitch changes corresponding to radial motion of the propeller blades caused by centrifugal force developed by the rotating propeller.

U.S. Pat. No. 2,457,576 to Littrell is directed to a variable pitch propeller that is controlled manually from the cockpit by means of an electric motor controlling a ring gear turning a pinion to move a nut inwardly or outwardly in a spiral groove.

U.S. Pat. Nos. 2,108,245 and 2,120,168 to Ash, Jr. are directed to helicopter rotors employing telescoping airfoil sections controlled from the cockpit by means of coil springs and wound cables.

U.S. Pat. No. 2,005,343 to Kent is directed to a variable propeller in which set screws project through a hub block into communication with each end of an arcuate slot to thereby adjustably limit the range of pitch variation of the propeller.

Those of the above prior art references that describe systems for automatically varying the pitch of propeller blades by centrifugal force that is developed by the rotating propeller all employ elements containing either a slot or a groove that is strictly linear, arcuate or helical in shape. This results in a linear relationship between propeller speed and propeller pitch, which is undesirable from an operational standpoint.

It would be advantageous to provide different rates of change of propeller pitch as a function of propeller speed or RPM to accommodate different ground or flight operations. For example, over a range of propeller speeds at which taxi operations may occur, it may be desirable to maintain the same or nearly the same propeller pitch. It may then be desirable to provide a greater rate of change of propeller pitch when increasing the propeller speed to a range suitable for flight climb conditions and to maintain a particular propeller pitch nearly constant over the range of propeller speeds suitable for cruise conditions.

It is therefore the principal object of the present invention to provide an automatic centrifugal force variable pitch propeller in which the relationship between propeller speed and propeller pitch is nonlinear; that is, the rate of change of propeller pitch is not constant with changes in propeller speed.

It is another object of the present invention to provide an automatic variable pitch propeller in which the individual propeller blades are mechanically linked to insure that inward and outward travel of the blades is in concert.

These and other objects are accomplished in accordance with one illustrated embodiment of the present invention by providing at least a pair of propeller blades mounted within a housing, each of the propeller blades being arranged for inward and outward axial travel and simultaneous incremental rotation about its longitudinal axis, a pair of mirror image cam/guide plates fixedly mounted within the housing adjacent a shaft end of each of the propeller blades, each of the mirror image cam/-guide plates having a nonlinear, discontinuous configuration, and a pin follower transversely extending from the shaft end of each of the propeller blades and being positioned for engagement with the nonlinear, discontinuous configuration in each of the mirror image cam/-guide plates, whereby an increase in the speed at which the propeller blades turn produces an increase in centrifugal force causing outward travel of the propeller blades and incremental rotation of each of the blades about its longitudinal axis corresponding to movement of each of the pin followers in the associated pair of mirror image cam/guide plates. In another illustrated embodiment of the present invention, a slotted cylinder fixedly positioned over the shaft end of each of the propeller blades is employed in place of the mirror image cam/guide plates.

DETAILED DESCRIPTION OF THE PREFERRED EMBODIMENTS

Figure 1:
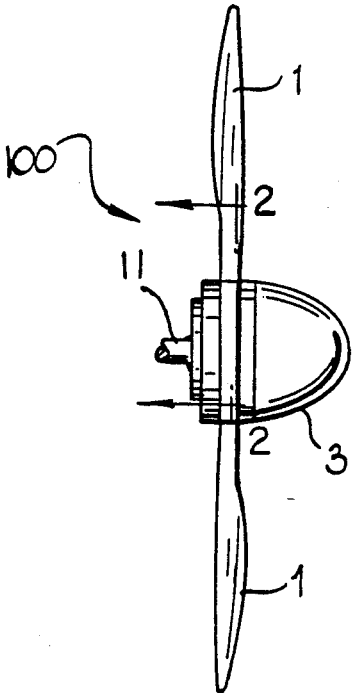
FIG. 1 is a general pictorial diagram of a two-bladed automatic centrifugal force variable pitch propeller system constructed in accordance with the present invention.

Referring now to FIG. 1, there is shown a propeller assembly 100 driven externally by way of a drive shaft 11. Propeller assembly 100 includes a pair of blades 1 and an outer housing 3. While the propeller of the present invention is described herein as being an aircraft propeller, the principles of the invention could as well be employed in connection with propellers for watercraft, windmills, and wind-powered electric generators, as well as vanes, blades, and paddles employed in pumps, turbine engines, etc. In certain ones of such applications, such as a windmill, drive shaft 11 becomes a driven shaft.

Figure 3:
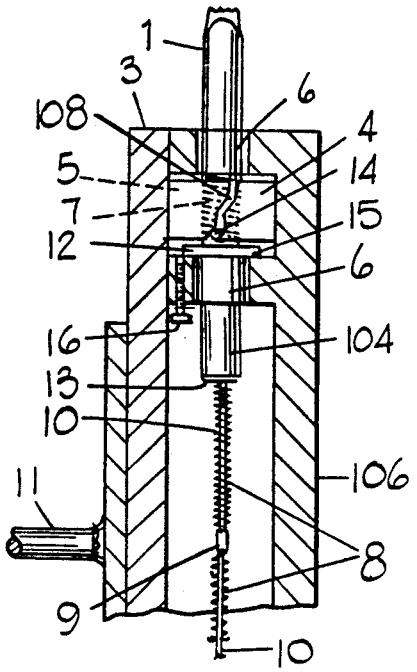
FIG. 3 is a cross-sectional diagram of the propeller system of FIG. 2 taken along the line 3—3.
Figure 2:
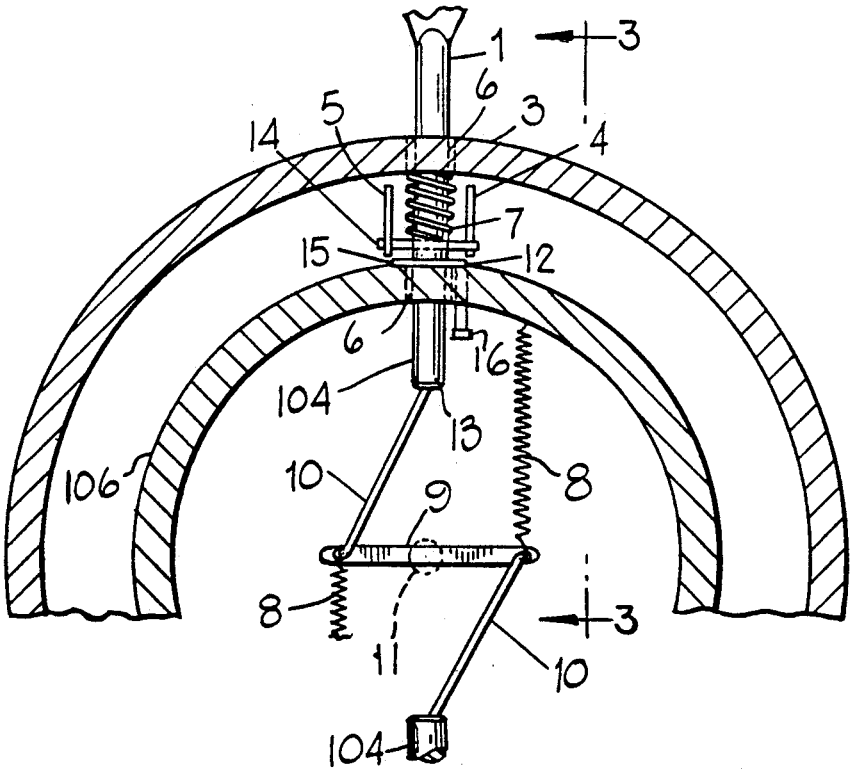
FIG. 2 is a cross-sectional diagram of the propeller system of FIG. 1 taken along the line 2—2.

Referring now to the embodiment of the present invention illustrated in FIGS. 2 and 3, each of the propeller blades 1 includes a shaft 104 that extends inwardly through a pair of conventional bearings 6 mounted in aligned apertures in outer housing 3 and inner housing 106. Bearings 6 are arranged to permit inward and outward axial travel of propeller blade 1, as well as rotational motion of propeller blade 1 about its longitudinal axis in response to decreases and increases in the speed of propeller assembly 100. A pair of mirror image cam/guide plates 4, 5 are mounted between outer housing 3 and inner housing 106 on opposite sides of shaft 104 of propeller blade 1. Each of the mirror image cam/guide plates 4, 5 includes a nonlinear, discontinuous configuration 108 like that illustrated in FIG. 5. A pin follower 14 is fixedly attached to the shaft portion 104 of propeller blade 1 and arranged for engagement with each of the mirror image cam/guide plates 4, 5. Alternatively, the configuration 108 may be provided as a groove in shaft 104 of each of the propeller blades 1, and pin follower 14 may be fixedly attached to inner housing 106 so as to engage the groove. A compression spring 7 is positioned on shaft 104 outward of pin followers 14 to return propeller blade 1 to its inwardmost position when propeller assembly 100 is not turning. At each propeller speed (RPM), the force imparted by compression spring 7 exactly offsets the centrifugal force developed by propeller blade 1. An optional retaining collar 12 is fixedly positioned on inner housing 106 inward of compression spring 7 to limit the inward and outward travel of propeller blade 1. One or more shims 15 are positioned on shaft 104 inward of retaining collar 12 to adjust the limit of travel of propeller blade 1. One or more adjusting screws 16 in inner housing 106 to adjust retaining collar 12 may also be employed to make slight adjustments in the limit of inward and outward travel of propeller blade 1. A crank 9, having a central pivot point that is aligned with the axis of drive shaft 11, is connected by way of connecting or push rods 10 to the inward ends of each of two shafts 104. Connection of push rods 10 to the ends of shafts 104 may be accomplished by way of a conventional swivelling connection, such as a ball and socket assembly or a swivel clevis, for example, that allows propeller assembly 100 to turn in a manner unimpeded by push rods 10. The combination of crank 9 and push rods 10 serves to mechanically link each of the propeller blades 1 to thereby assure uniform and identical inward and outward travel thereof and to preclude an out of balance or dissimilar pitch condition between any of the propeller blades 1. Tension springs 8 may be connected between inner housing 106 and each end of crank 9 to assist spring 7 in returning each of the propeller blades 1 to its inwardmost position when propeller assembly 100 is not turning.

Figure 4:
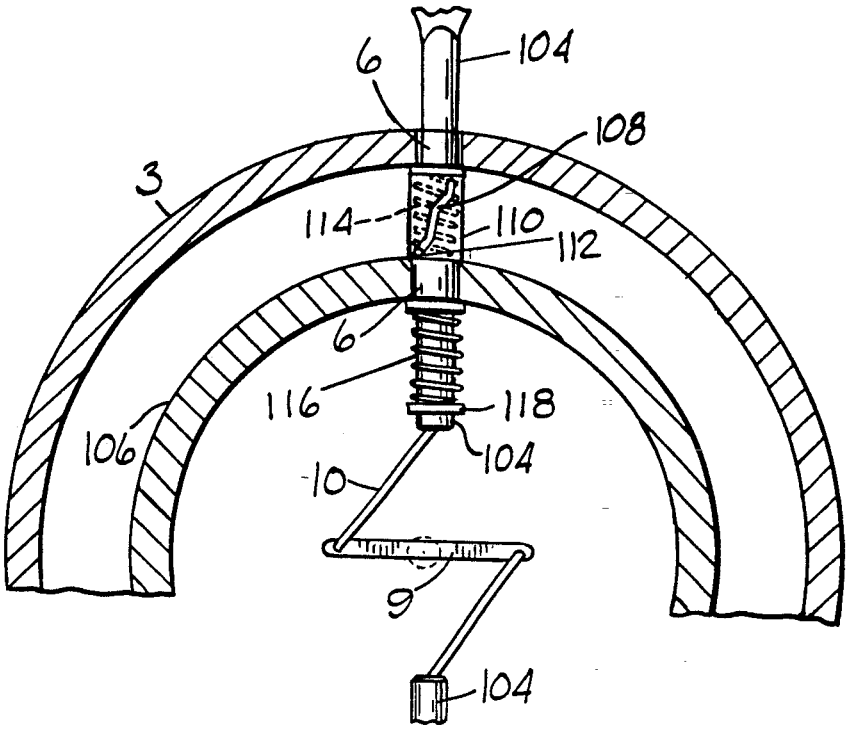
FIG. 4 is a cross-sectional diagram of the propeller system of FIG. 1 taken along the line 2—2, illustrating an alternative embodiment thereof.

Referring now to FIG. 4, there is shown an alternative embodiment of the present invention in which a slotted cylinder 110 is mounted over shaft 104 of each of the propeller blades 1 between bearings 6 mounted in apertures in the outer and inner housings 3, 106. A pin 112, fixedly positioned in shaft 104 transverse to the longitudinal axis thereof, engages slot 108 to cause rotation of propeller blade 1 about its longitudinal axis as propeller blade 1 travels inward and outward with decreases and increases, respectively, in the speed of propeller assembly 100. A compression spring 114, positioned over shaft 104 inside slotted cylinder 110, serves to return propeller blade 1 to its inwardmost position when propeller assembly 100 is not turning. Another compression spring 116 is positioned over shaft 104 between bearing 6 in inner housing 106 and a retaining pin 118 that is transversely mounted in shaft 104 proximate the inward end thereof. Compression spring 116 serves to assist compression spring 114.

Figure 4A:
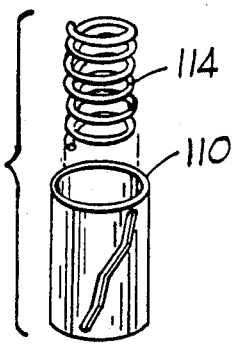
FIG. 4A is a pictorial diagram of a slotted cylinder employed in the propeller system of FIG. 4 that serves to define a configuration of propeller pitch with respect to propeller speed.
Figure 5:
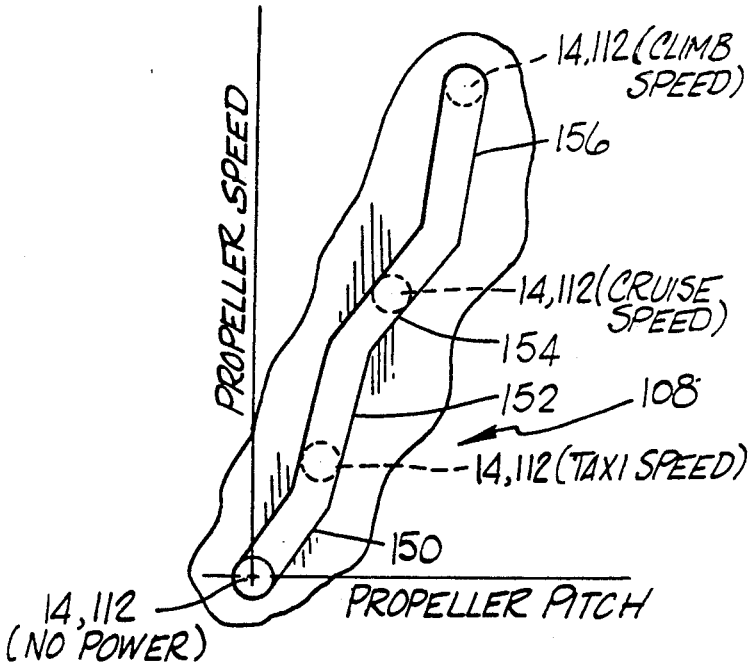
FIG. 5 is a diagram illustrating an exemplary configuration of the cam/guide or the slotted cylinder variously employed in the automatic centrifugal force variable pitch propeller system of FIGS. 1-4A.

Referring now to FIG. 5, there is shown an exemplary configuration of mirror image cam/guide plates 4, 5 in the embodiment of FIGS. 2 and 3 or of slot 108 in slotted cylinder 110 in the embodiment of FIGS. 4 and 4A. The position of pin follower 14 of FIGS. 2 and 3 or of pin 112 of FIGS. 4 and 4A in slot 108 at various propeller speeds is also shown, along with the corresponding propeller pitch at each of those propeller speeds. As described above, the arcuate or helical slots taught in the prior art produce a constant rate of change in propeller pitch with changes in propeller speed. In other words, the prior art slots result in a linear relationship between propeller pitch and propeller speed. The nonlinear, discontinuous slot 108 of the present invention is made up of a number of linear segments 150, 152, 154, and 156 that serve to produce varying rates of change in propeller pitch with changes in propeller speed, resulting in a nonlinear relationship between propeller pitch and propeller speed.

The configuration of slot 108 may be altered to suit various aircraft types, engine horsepowers, or flight purposes. Therefore, it is anticipated that many different interchangeable mirror image cam/guide plates 4, 5 in the embodiment of FIGS. 2 and 3 or slotted cylinders 110 in the embodiment of FIGS. 4 and 4A, each having different configurations, may be made available to users.

In operation, the embodiment of the automatic centrifugal force variable pitch propeller illustrated in FIGS. 2 and 3 provides a varying rate of change in the pitch of each of the propeller blades 1, in accordance with the configuration of slot 108 of FIG. 5, for example, that is presented in mirror image cam/guide plates 4, 5, as the propeller blades 1 travel outwardly due to increasing centrifugal force developed by increasing speed of the propeller. As described in detail above, the embodiment of the automatic variable pitch propeller illustrated in FIGS. 4 and 4A provides the same varying rate of change in the pitch of each of the propeller blades 1, in accordance with the configuration of slot 108 of FIG. 5, for example, that is presented in slotted cylinder 110.

I claim:

1. An automatic centrifugal force variable pitch propeller assembly comprising:

a housing mounted to a rotatable shaft;

a plurality of propeller blades, each having a blade end and a cylindrical shaft end, the shaft end of each of the propeller blades being mounted within the housing such that the propeller blades extend radially from the housing, each of the propeller blades being mounted to permit limited radial travel in its entirety along a horizontal axis of each of the propeller blades and simultaneous limited rotation about said longitudinal axis, the limited radial travel of each of the propeller blades in its entirety being caused by a centrifugal force developed by rotation of the propeller assembly, the limited radial travel of each of the propeller blades in its entirety extending between an inward position corresponding to rotation of the propeller assembly at an idle speed and an outward position corresponding to rotation of the propeller assembly at a maximum speed;

pitch change means mounted within the housing and coupled to the shaft end of each of the propeller blades, the pitch change means being solely responsive to radial travel of each of the propeller blades in its entirety, caused by said centrifugal force developed by rotation of the propeller assembly, for causing an identical predetermined incremental rotation of each of the propeller blades about said longitudinal axis, said identical predetermined incremental rotation of each of the propeller blades being a nonlinear function of the radial travel of each of the propeller blades in its entirety; and crank and push rod means for providing a rigid mechanical interconnection between the shaft ends of each of the propeller blades to in sure that the propeller blades travel radially in their entirety in concert with each other to thereby provide fail safe operation of the propeller assembly.

2. An automatic centrifugal force variable pitch propeller assembly as in claim 1 wherein said pitch change means comprises:

a pair of mirror image cam/guide plates, said pair of mirror image cam/guide plates being fixedly mounted within said housing adjacent the shaft end of an associated one of the propeller blades and on opposite sides thereof, said pair of mirror image cam plates including a nonlinear, discontinuous configuration that comprises a plurality of linear segments; and a pin follower transversely mounted on the shaft end of each one of the propeller blades, each pin follower engaging an adjacent pair of said mirror image cam/guide plates.

3. An automatic centrifugal force variable pitch propeller assembly as in claim 1 wherein said pitch change means comprises:

a cylindrical sleeve positioned over the shaft end of each of the propeller blades and fixedly mounted within said housing, each cylindrical sleeve being configured to include a nonlinear slot that comprises a plurality of linear slot segments; and a pin follower transversely mounted on the shaft end of each of the propeller blades, each pin follower engaging the nonlinear slot in an associated one of said cylindrical sleeves.

* * * * *